US008988182B2

(12) United States Patent
Kern

(10) Patent No.: US 8,988,182 B2
(45) Date of Patent: Mar. 24, 2015

(54) TRANSFORMERS AND METHODS FOR CONSTRUCTING TRANSFORMERS

(75) Inventor: Gregory Allen Kern, Redwood City, CA (US)

(73) Assignee: SunEdison, Inc., Maryland Heights, MO (US)

( * ) Notice: Subject to any disclaimer, the term of this patent is extended or adjusted under 35 U.S.C. 154(b) by 198 days.

(21) Appl. No.: 13/425,561

(22) Filed: Mar. 21, 2012

(65) Prior Publication Data

US 2012/0243268 A1 Sep. 27, 2012

Related U.S. Application Data

(60) Provisional application No. 61/465,632, filed on Mar. 22, 2011.

(51) Int. Cl.
*H01F 27/28* (2006.01)
*H01F 30/12* (2006.01)

(52) U.S. Cl.
CPC ..... *H01F 30/12* (2013.01); *H01F 27/2895* (2013.01)
USPC ..... 336/229; 336/221; 336/170; 363/21.12

(58) Field of Classification Search
CPC ..... H01F 17/062; H01F 17/06; H01F 30/12; H01F 27/2895
USPC ..... 336/200, 206–215, 170, 223, 205, 233, 336/221, 229; 363/21.01, 21.12
See application file for complete search history.

(56) References Cited

U.S. PATENT DOCUMENTS 5,341,281 A 8/1994 Skibinski
6,300,857 B1 * 10/2001 Herwig ..... 336/229
6,507,260 B1 * 1/2003 Baumann et al. ..... 336/90
6,538,905 B2 * 3/2003 Greenfeld et al. ..... 363/17
7,449,987 B2 * 11/2008 Snyder ..... 336/200
7,729,135 B1 * 6/2010 Schimel ..... 363/21.01
7,746,211 B2 * 6/2010 Pokharna et al. ..... 336/229
2004/0080393 A1 * 4/2004 Phadke ..... 336/206
2009/0167474 A1 * 7/2009 Moon et al. ..... 336/182
2012/0092116 A1 4/2012 Ger et al.

FOREIGN PATENT DOCUMENTS

JP 2011142218 A 7/2011
WO 2011118004 A1 9/2011

OTHER PUBLICATIONS

PCT International Search Report and Written Opinion of the International Searching Authority mailed on Jul. 5, 2012 regarding PCT/US2012/030044; 10 pages.

* cited by examiner

*Primary Examiner* — Timothy J Dole
*Assistant Examiner* — Shahzeb K Ahmad
(74) *Attorney, Agent, or Firm* — Armstrong Teasdale LLP

(57) ABSTRACT

Transformers and methods of constructing transformers are disclosed. In one embodiment, a method of constructing a transformer includes wrapping a first primary winding around a core, wrapping a secondary winding around the core, and wrapping a second primary winding around the core. The first primary winding traverses substantially an entire circumference of the core in a first circumferential direction. The secondary winding includes a first half and a second half. The first half traverses substantially the entire circumference of the core in the first circumferential direction, and the second half traverses substantially the entire circumference of the core in a second circumferential direction opposite the first circumferential direction. The second primary winding traverses substantially the entire circumference of the core in the second circumferential direction.

23 Claims, 9 Drawing Sheets

TRANSFORMERS AND METHODS FOR CONSTRUCTING TRANSFORMERS

CROSS-REFERENCE TO RELATED APPLICATIONS

This application claims priority to U.S. Provisional Application No. 61/465,632 filed Mar. 22, 2011, the entire disclosure of which is hereby incorporated by reference in its entirety.

FIELD

This disclosure generally relates to transformers and, more specifically, methods for constructing transformers having a relatively low leakage inductance.

BACKGROUND

Solar panels, also referred to herein as photovoltaic (PV) modules, generally output direct current (DC) electrical power. To properly couple such solar panels to an electrical grid, or otherwise provide alternating current (AC) power, the electrical power received from the solar panels is converted from DC to AC power. At least some known solar power systems use a single stage or a two-stage power converter to convert DC power to AC power. Some systems are controlled by a control system to maximize the power received from the solar panels and to convert the received DC power into AC power that complies with utility grid requirements.

However, at least some known solar power converters are relatively inefficient and/or unreliable. It is desirable for a solar power converter to operate at relatively high efficiency to capture as much energy from a PV module as possible. At least some solar power converters utilize an isolated DC/DC converter including a transformer. One of the loss factors in such converters is the energy loss associated with the leakage inductance of the converter's transformer. In some converters, the losses are proportional to the leakage inductance of the transformer. A greater leakage inductance leads to greater losses and, accordingly, to a lower total conversion efficiency. Some known designs attempt to recover the energy stored in the leakage inductance. These recovery mechanisms, however, are generally not satisfactory.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

BRIEF SUMMARY

One aspect of the present disclosure is a method of constructing a transformer. The method includes wrapping a first primary winding around a core, wrapping a secondary winding around the core, and wrapping a second primary winding around the core. The first primary winding traverses substantially an entire circumference of the core in a first circumferential direction. The secondary winding includes a first half and a second half. The first half traverses substantially the entire circumference of the core in the first circumferential direction, and the second half traverses substantially the entire circumference of the core in a second circumferential direction opposite the first circumferential direction. The second primary winding traverses substantially the entire circumference of the core in the second circumferential direction.

Another aspect of the present disclosure is a transformer. The transformer includes a core having an outer circumference, a first primary winding including a plurality of turns wound on the core, a secondary winding including a first portion and a second portion, and a second primary winding including a plurality of turns wound on the core. The plurality of turns of the first primary winding traverse in a first circumferential direction around the core. The first portion of the secondary winding includes a plurality of turns traversing in the first circumferential direction around the core. The second portion of the secondary winding includes a plurality of turns traversing in the second circumferential direction around the core. The plurality of turns of the second primary winding traverse in the second circumferential direction around the core.

Yet another aspect of the present disclosure is a power conversion system. The system includes a power converter configured to convert an input power to an output power. The power converter includes a controller, at least one switch, and a transformer. The transformer includes a core, a first primary winding, a secondary winding, and a second primary winding. The first primary winding includes a plurality of turns wound on the core. The plurality of turns traverses in a first circumferential direction around the core. The secondary winding includes a first portion and a second portion. The first portion includes a plurality of turns traversing in the first circumferential direction around the core. The second portion includes a plurality of turns traversing in a second circumferential direction around the core. The second primary winding includes a plurality of turns wound on the core. The plurality of turns traverses in the second circumferential direction around the core.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Like reference symbols in the various drawings indicate like elements.

DETAILED DESCRIPTION

The embodiments described herein generally relate to transformer. More specifically embodiments described herein relate to methods for constructing transformers having relatively low leakage inductance. Moreover, some embodiments described herein relate to transformers and methods of constructing transformers for power converters for use with a photovoltaic (PV) power source.

Although described herein with reference to power converters in general and for use with a PV source, the teachings of this disclosure may be utilized to construct relatively low leakage inductance transformers for any suitable use.

Figure 1:
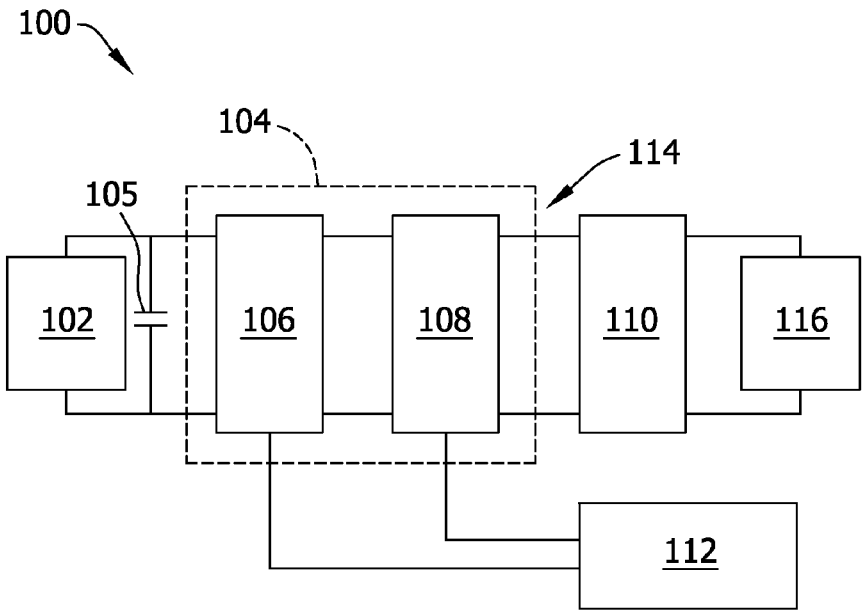
FIG. 1 is a schematic block diagram of an embodiment of a power conversion system.

FIG. 1 is a schematic block diagram of this power conversion system 100. A power source 102 is coupled to power conversion system 100 to supply electrical current to system 100. In this embodiment, power source 102 is a photovoltaic or "solar" array that includes at least one photovoltaic panel. Alternatively or additionally, power source 102 includes at least one fuel cell, a direct current (DC) generator, and/or any other electric power source that enables power conversion system 100 to function as described herein.

In this embodiment, power conversion system 100 includes a power converter 104 to convert DC power received from power source 102, via an input capacitor 105, to an alternating current (AC) output. In other embodiments, power converter 104 may output DC power. This power converter 104 is a two stage power converter including a first stage 106 and a second stage 108. First stage 106 is a DC to DC power converter that receives a DC power input from power source 102 and outputs DC power to second stage 108. Second stage 108 is a DC to AC power converter (sometimes referred to as an inverter) that converts DC power received from first stage 106 to an AC power output. In other embodiments, power converter 104 may include more or fewer stages. More particularly, in some embodiments power converter 104 includes only second stage 108.

Power conversion system 100 also includes a filter 110, and a control system 112 that controls the operation of first stage 106 and second stage 108. An output 114 of power converter 104 is coupled to filter 110. In this embodiment, filter 110 is coupled to an electrical distribution network 116, such as a power grid of a utility company. Accordingly, power converter 104 may be referred to as a grid tied inverter. In other embodiments, power converter 104 may be coupled to any other suitable load.

During operation, power source 102 generates a substantially direct current (DC), and a DC voltage is generated across input capacitor 105. The DC voltage and current are supplied to power converter 104. In this embodiment, control system 112 controls first stage 106 to convert the DC voltage and current to a substantially rectified DC voltage and current. The DC voltage and current output by first stage 106 may have different characteristics than the DC voltage and current received by first stage 106. For example, the magnitude of the voltage and/or current may be different. Moreover, in this embodiment, first stage 106 is an isolated converter, which operates, among other things, to isolate power source 102 from the remainder of power conversion system 100 and electrical distribution network 116. More specifically, in this embodiment, first stage 106 is a flyback converter. The DC voltage and current output by first stage 106 are input to second stage 108, and control system 112 controls second stage 108 to produce AC voltage and current, and to adjust a frequency, a phase, an amplitude, and/or any other characteristic of the AC voltage and current to match the electrical distribution network 116 characteristics. The adjusted AC voltage and current are transmitted to filter 110 for removing one or more undesired characteristics from the AC voltage and current, such as undesired frequency components and/or undesired voltage and/or current ripples. The filtered AC voltage and current are then supplied to electrical distribution network 116.

Figure 2:
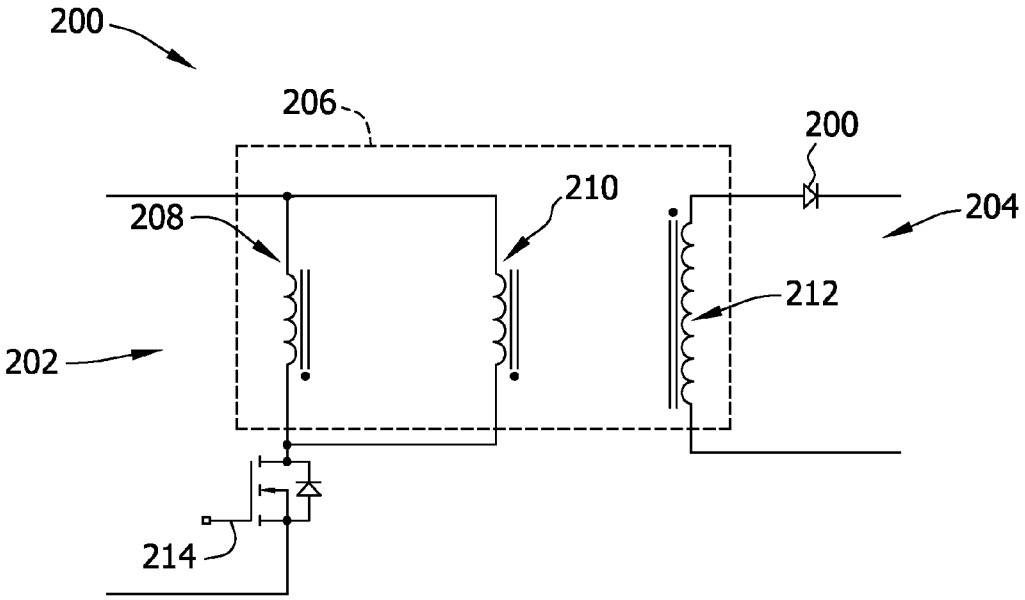
FIG. 2 is a schematic diagram of a converter for use in the system shown in FIG. 1.

FIG. 2 is a simplified schematic diagram of this converter 200 for use as first stage 106. Converter 200 is an isolated converter. More specifically, converter 200 is a flyback converter. Converter 200 is operable to receive DC power at an input 202 and output DC power at an output 204. In this embodiment, converter 200 is operated by control system 112 to output DC power to electrical second stage 108. Generally, the peak output voltage of converter 200 is greater than the input voltage to converter 200.

Converter 200 includes a transformer 206 having a first primary winding 208, a second primary winding 210, and a secondary winding 212. Primary windings 208 and 210 are magnetically coupled to, but electrically isolated from, secondary winding 212. Primary windings 208 and 210 are connected to input 202 in parallel with each other. First primary winding 208 and second primary winding 210 are coupled to a switch 214. In this embodiment, switch 214 is a MOSFET. In other embodiments, switch 214 may be any other suitable switch.

Converter 200 is generally operated as a flyback converter as known in the art. In general, switch 214 is switched on and off to store and release energy in transformer 206. More specifically, when switch 214 is closed (also referred to as switched on), current flows through first and second primary windings 208 and 210 and energy is stored in the core (not shown in FIG. 2) of transformer 206. When switch 214 is opened (also referred to as switched off), current ceases flowing through first and second primary windings 208 and 210. Current flow is induced in secondary winding 212, releasing the energy stored in the core of transformer 206 to the output 204. The output of transformer 206, and more specifically the output of secondary winding 212, is rectified by a diode 218. Thus, DC output power is provided at output 204 of converter 200.

Figure 3:
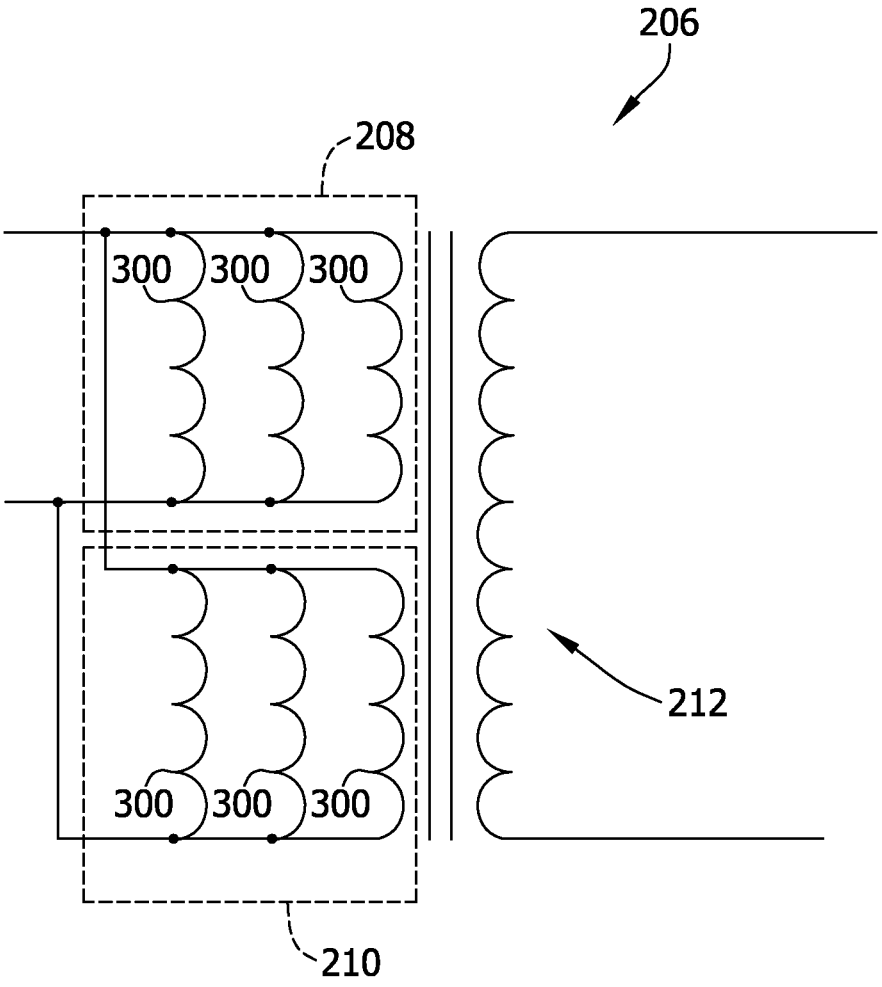
FIG. 3 is a schematic diagram of a transformer for use in the converter shown in FIG. 2.

FIG. 3 is a schematic diagram of this embodiment of transformer 206 for use in converter 200. Each primary winding 208 and 210 includes three windings 300 connected in parallel. As will be described in more detail below, each primary winding 208 and 210 includes three conductors, one for each winding 300, connected together in parallel.

In this embodiment, transformer 206 is a low leakage inductance transformer. As described above, losses in an isolated converter, such as converter 200, are proportional to the leakage inductance of the transformer. Accordingly, by reducing the inductance of transformer 206 over some known designs, the losses in converter 200 may be reduced.

In one embodiment, a method of constructing a transformer, such as transformer 206, includes wrapping a first primary winding around a toroidal core. The first primary winding traverses substantially the entire circumference of the toroidal core in a first circumferential direction. A secondary winding is wrapped around the toroidal core. The secondary winding includes a first half and a second half. The first half of the secondary winding traverses substantially the entire circumference of the toroidal core in the first circumferential direction and the second half of the secondary winding traverses substantially the entire circumference of the toroidal core in a second circumferential direction. The second circumferential direction is opposite the first circumferential direction. The method includes wrapping a second primary winding around the toroidal core. The second primary winding traverses substantially the entire circumference of the toroidal core in the second circumferential direction.

With reference to FIGS. 4-8, construction of an embodiment of transformer 206 according to the method will be described. The transformer 206 includes a first primary winding 208 and a second primary winding 210 each having twenty-one turns, and a secondary winding having one hundred and sixty turns. The method described above and transformer 206 are not limited, however, to a transformer as described hereinafter. In other embodiments, transformer 206 may have a different numbers of turns, a different turns ratios, different numbers of windings, and/or may be constructed of different materials.

FIGS. 4-9 illustrate construction of an embodiment of transformer 206 that may be used in a power converter, such as power converter 200. Transformer 206 includes a magnetic core 400 visible in FIGS. 4 and 5. In this embodiment, core 400 is a toroidal core. In other embodiments, core 400 may have any other suitable shape. The core 400 is a distributed air gap toroidal core made from powder core material. The powder core material may be any suitable magnetic powder core material or combination of materials including, for example, nickel, iron, molybdenum. Moreover, in other embodiments, core 400 may be made of any other suitable materials and/or constructions including for example, iron, laminated silicon steel, carbonyl iron, ferrite, tape wound, etc.

Figure 4:
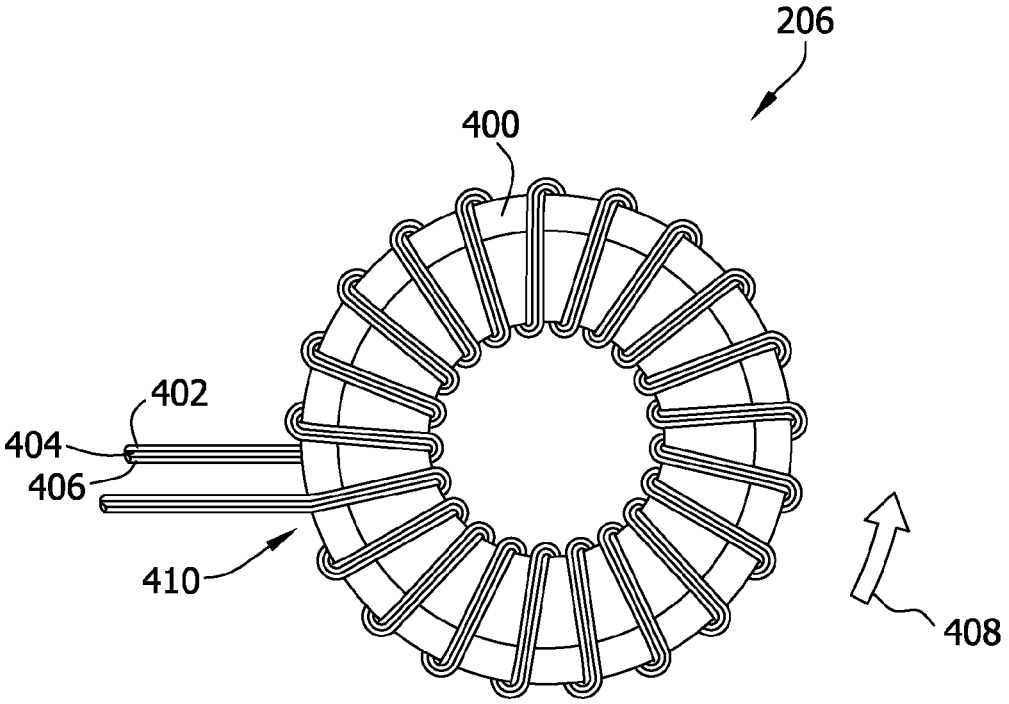
FIGS. 4-9 illustrate construction of the transformer for use in the converter shown in FIG. 2.
Figure 5:
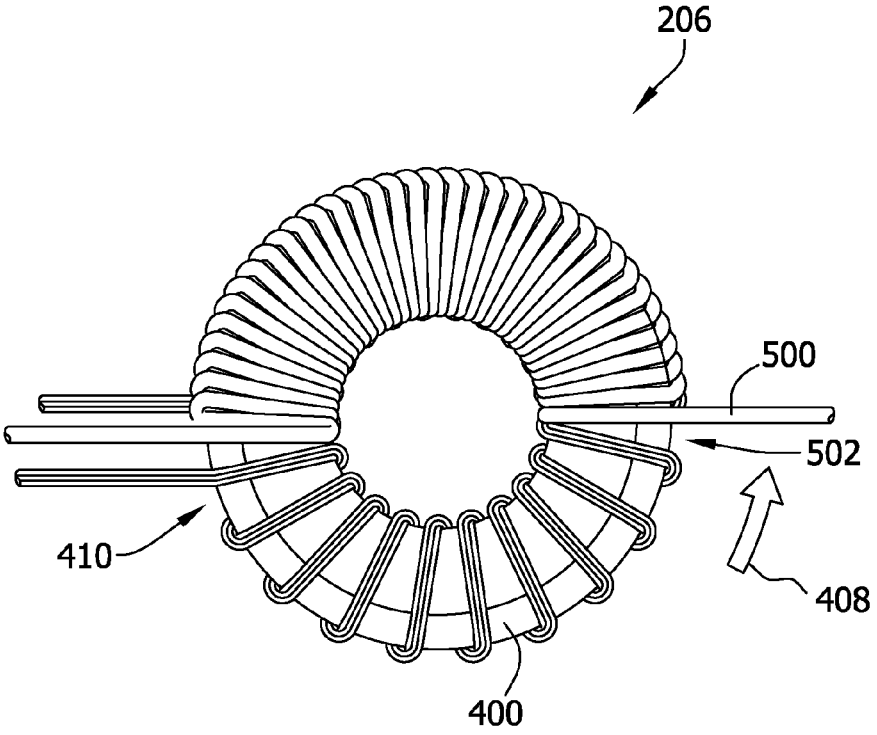

In FIG. 4, first primary winding 208 has been wound onto core 400. In this embodiment, three conductors 402, 404, and 406 are wrapped around core 400 in a counterclockwise direction 408. Each one of conductors 402-406 will become one winding 300 of first primary winding 208. In this embodiment, conductors 402-406 are No. 22 AWG magnet wire. In other embodiments, any other suitable conductive material may be used. Conductors 402-406 are wrapped around core 400 twenty-one times beginning at point 410 to form a twenty-one turn primary winding 208. Each turn of conductors 402-406 is spaced apart from each other turn such that the completed twenty-one turns traverse substantially the entire circumference of core 400 to form first primary winding 208.

Figure 6:
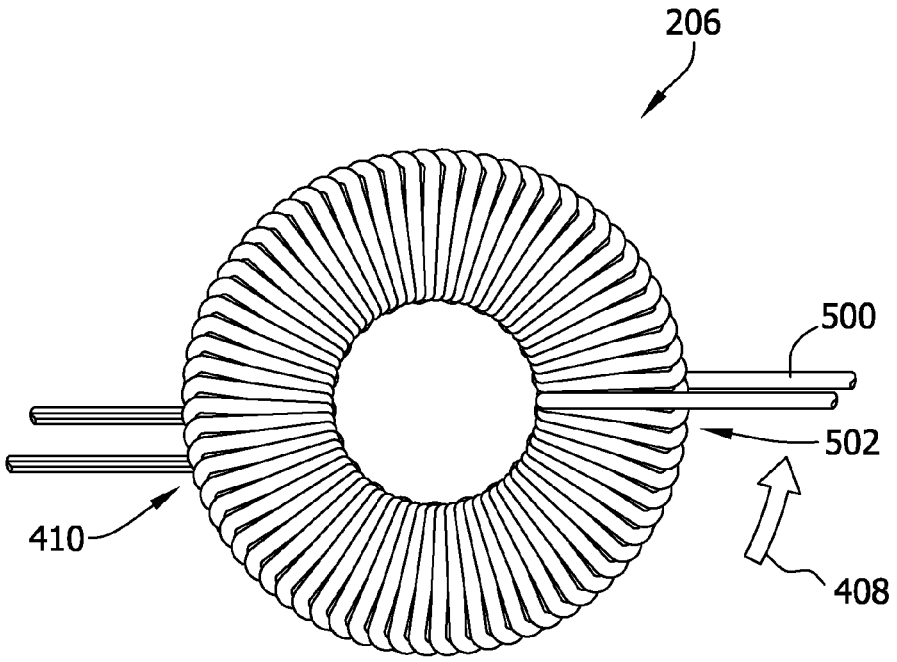

Secondary winding 212 is wound on core 400 in FIGS. 5-8. A single conductor 500 is wound around core 400 beginning at point 502 to form secondary winding 212. Point 502 is located approximately 180 degrees around the circumference of core 400 from point 410 at which first primary winding 208 began and ended. In this embodiment, conductor 500 is 0.4 millimeter (mm) triple insulated wire (TIW). In other embodiments, any other suitable conductive material may be used. Conductor 500 is wrapped around core 400 forty times beginning at point 502 and ending at point 410 in FIG. 5. An additional forty turns are wrapped around core 400 ending substantially at point 502 in FIG. 6. In FIG. 6, conductor 500 has been wrapped a total of eighty turns around core 400 traversing substantially the entire circumference of core 400 in counterclockwise direction 408 beginning and ending at point 502. These first eighty turns form a first portion of secondary winding 212.

Figure 7:
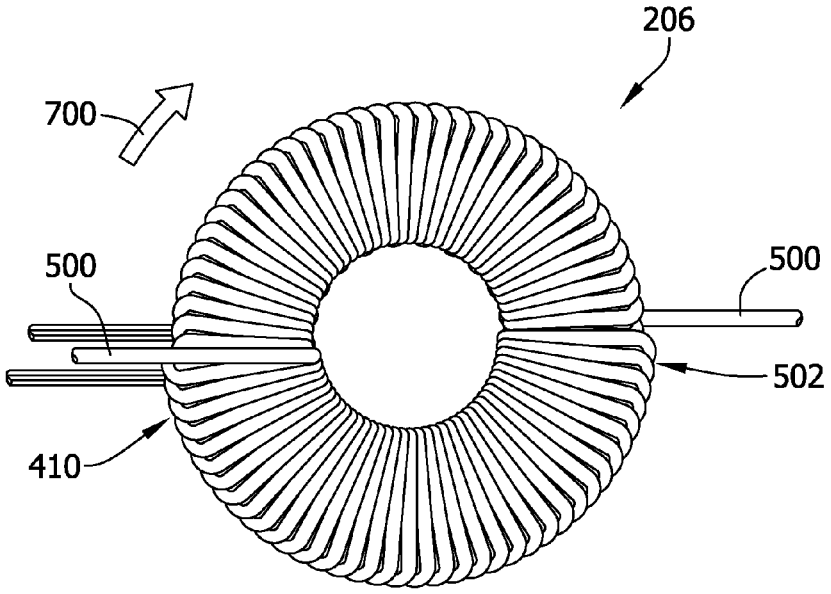
Figure 8:
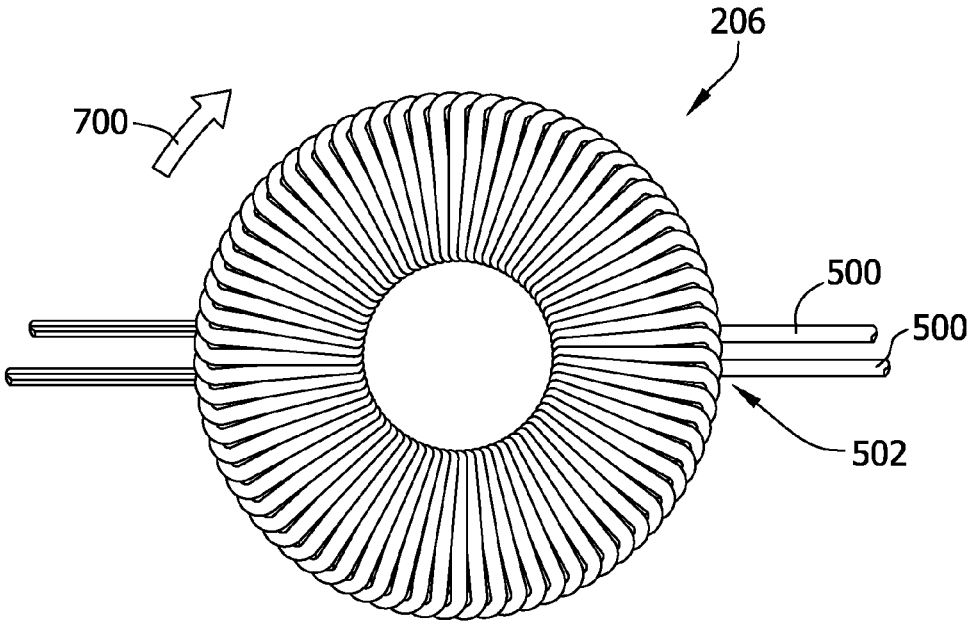

A second portion of secondary winding 212, e.g., the remaining eighty turns, is wound on core 400 in a clockwise direction 700 in FIGS. 7 and 8 using the same conductor 500. In the embodiment shown in FIG. 7, approximately forty turns of the second portion of secondary winding 212 have been wound around core 400 beginning point 502 and ending at point 410. An additional forty turns are wrapped around core 400 in clockwise direction 700 ending substantially at point 502 in FIG. 8. In the embodiment of FIG. 8, conductor 500 has been wrapped eighty turns around core 400 in counterclockwise direction 408 and eighty turns around core 400 in clockwise direction 700.

Figure 9:
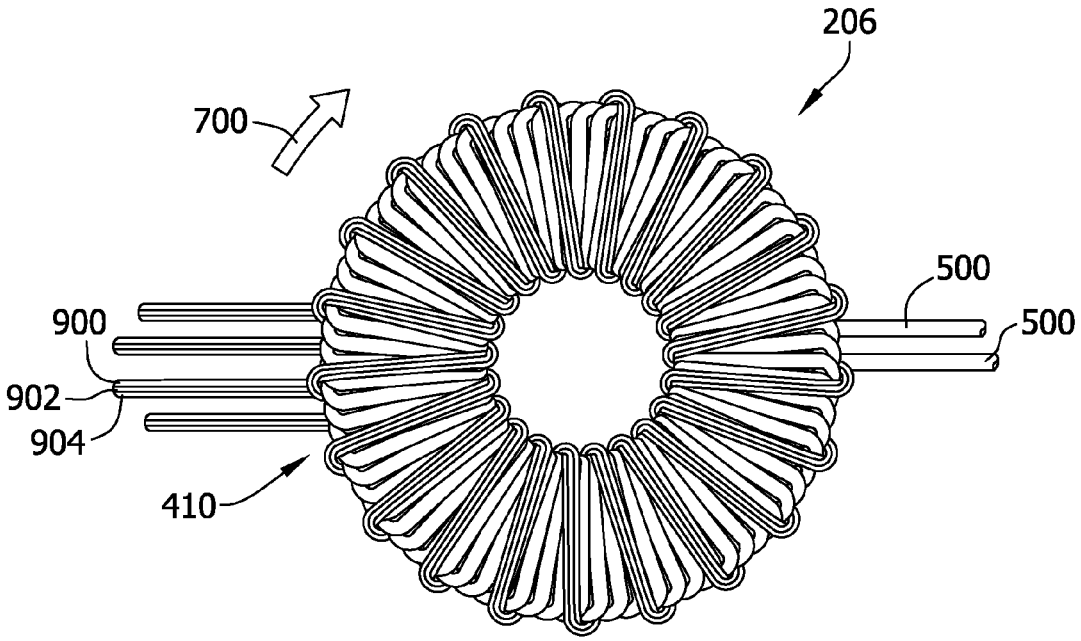

In FIG. 9, second primary winding 210 has been wound onto core 400. In this embodiment, three conductors 900, 902, and 904 are wrapped around core 400 in clockwise direction 700. Each one of conductors 900-904 will become one winding 300 of second primary winding 210. In this embodiment, conductors 900-904 are No. 22 AWG magnet wire. In other embodiments, any other suitable conductive material may be used. In this embodiment, conductors 900-904 are wrapped around core 400 twenty-one times beginning at point 410 to form a twenty-one turn primary winding 210. Each turn of conductors 900-904 is spaced apart from each other turn such that the completed twenty-one turns traverse substantially the entire circumference of core 400 to form second primary winding 210.

To complete transformer 206 as schematically shown in FIG. 3, first primary winding 208 and second primary winding 210 are connected together in parallel. More specifically, one end of each of conductors 402-406 is connected to the corresponding end of conductors 900-904. Because there is a single secondary winding 212, conductor 500 does not need to be connected to anything to complete construction of transformer 206. If desired, the ends of conductor 500 may be cut to a desired length, insulation may be removed from the cut ends, and the ends may be tinned with solder to prepare transformer 206 for installation in a circuit. Similarly, the ends of conductors 402-406 and 900-904 may be cut to length, stripped and tinned with solder. In some embodiments, additional windings may be added for low power auxiliary circuits, sensing, etc.

When completed, transformer 206 includes a first primary winding 208 and a second primary winding 210, each of which includes three windings, having a same number of turns. Moreover, first primary winding 208 and secondary winding 210 are wound in opposite directions around core 400. Similarly, secondary winding 212 includes a first portion and a second portion, having a same number of turns. The first portion and the second portion are wound in opposite directions around core 400. As will be explained in more detail below, these winding techniques may produce transformers having improved characteristics, including reduced leakage inductance, over some known transformers.

A prototype transformer was built as described herein. Specifically, the prototype included a powdered material toroidal core. The primary windings were wound from No. 22 AWG magnet wire, and the secondary winding was wound with 0.4 mm TIW in the manner shown in FIGS. 4-9. The two primary windings were connected in parallel, as also described above. The resulting transformer exhibited a primary magnetizing inductance (Lm) of 26.1 microhenries (uH), a primary self resonant frequency of 471 kilohertz (kHz), a leakage inductance (Le) of 0.112 uH, and a DC resistance of 0.010 ohms. The secondary winding of the prototype transformer had a DC resistance of 0.872 ohms. The turns ratio of the prototype was 7.62 and the leakage ratio, i.e. Le/Lm, was 0.0043.

A second transformer was constructed using techniques other than those described herein. In the second transformer, the first primary windings were wound around the core, the secondary winding was wound over the first primary winding, and the second primary windings was wound over the secondary winding. All of the windings were wound with the same direction around the circumference of the toroidal core, e.g., all clockwise or all counterclockwise. Furthermore, the second transformer did not match the number of turns on the first and second primary windings that were then paralleled. The second transformer had a leakage ratio three times the leakage ratio of the prototype transformer constructed using the methods described herein.

A third transformer was constructed exactly the same as the second transformer, but matching the number of turns in the first and second primary windings. The primary windings and the secondary winding were all wound in the same direction around the circumference of the toroidal core, e.g., all clockwise or all counterclockwise. The third transformer had a leakage ratio two times the leakage ratio of the prototype transformer constructed using the methods described herein.

Figure 10:
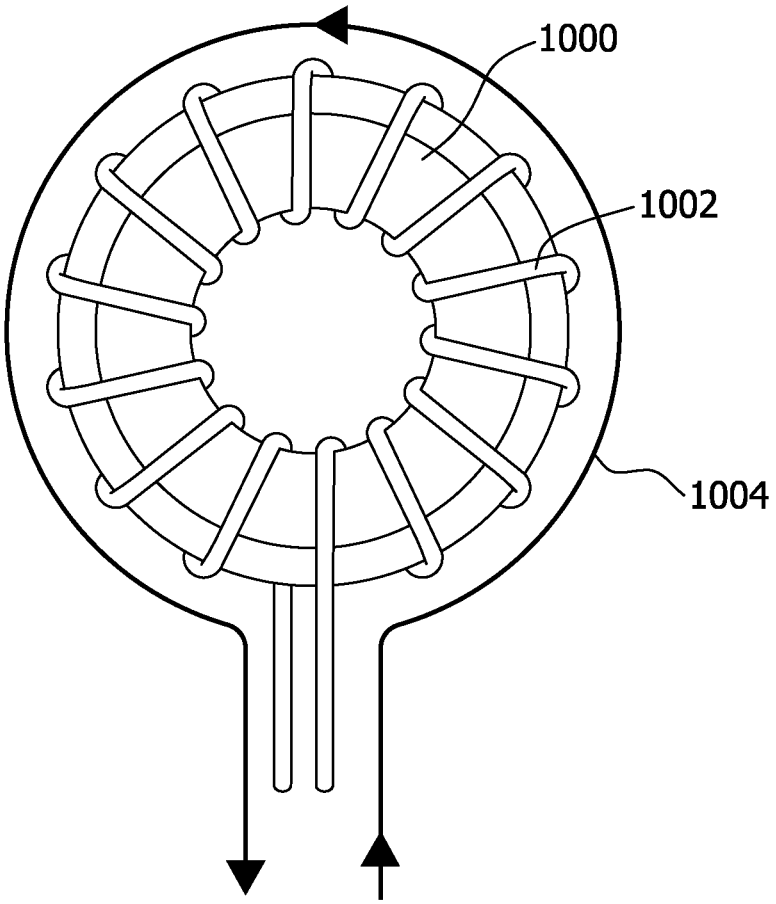
FIG. 10 shows a magnetic core with a single conductor defining one turn in air.

The reduced leakage inductance, and hence the reduced leakage ratio, of the prototype transformer constructed according to an embodiment of this disclosure as compared to, for example, the third prototype may be explained with reference to FIG. 10. FIG. 10 shows a toroidal core 1000 with a single conductor 1002 wrapped in fourteen turns around core 1000 in a counterclockwise direction. Each turn of conductor 1002 forms a loop around core 1000. As will be understood by one skilled in the art, current flowing through conductor 1002 generates a magnetic flux through core 1000. However, conductor 1002 also describes a turn around the circumference of core 1000, indicated by path 1004, sometimes referred to as a turn in air or air turn. Because of this turn in air, current through conductor 1002 also creates a magnetic flux that is not coupled to core 1000. This magnetic flux coupled through the air results in an increased leakage inductance. By winding first primary winding 208 and second primary winding 210 in opposite directions around the circumference of core 400 according to this disclosure, the turn in air from each winding 208 and 210 is canceled out, resulting in a zero net turn in air. Similarly, by winding a first portion of secondary winding 212 in a first direction around the core 400 and the second portion of the secondary winding 212 in a second direction, the turn in air of each portion is canceled out by the other, also resulting in a zero net turn in air. The leakage inductance may be further reduced by matching the number of turns in the opposite direction of the windings, e.g. matching the number of turns of first primary winding 208 and second primary winding 210.

Transformers constructed in accordance with this disclosure have a lower leakage inductance, and when such transformers are used in power converters, the lower leakage inductance results in reduced losses and higher efficiency.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A method of constructing a transformer, the method comprising:

wrapping a first primary winding around a core having an opening there through, the first primary winding continuously traversing substantially an entire circumference of the core in a first circumferential direction;

wrapping a secondary winding around the core, the secondary winding comprising a first half and a second half, each of the first half and the second half including a plurality of turns, each turn of the plurality of turns forming a substantially complete loop passing through the opening in the core, the first half continuously traversing substantially the entire circumference of the core in the first circumferential direction, the second half continuously traversing substantially the entire circumference of the core in a second circumferential direction opposite the first circumferential direction; and wrapping a second primary winding around the core, the second primary winding continuously traversing substantially the entire circumference of the core in the second circumferential direction.

2. A method in accordance with claim 1, wherein the first primary winding and the second primary winding comprise a same number of turns.

3. A method in accordance with claim 2, wherein the first half and the second half of the secondary winding comprise a same number of turns.

4. A method in accordance with claim 2, wherein the first primary winding comprises a plurality of conductors, and the second primary winding comprises a same number of conductors as the first primary winding.

5. A method in accordance with claim 2, wherein wrapping the first primary winding begins at a first position around the circumference of the core and wrapping the secondary winding around the core begins at a second position around the circumference of the core different than the first position.

6. A method in accordance with claim 5, wherein the second position is located about 180 degrees around the circumference of the core from the first position.

7. A method in accordance with claim 6, wherein wrapping the second primary winding begins at the first position.

8. A method in accordance with claim 2, further comprising coupling the first and second primary windings together in parallel.

9. A method in accordance with claim 1, wherein wrapping the first primary winding comprises wrapping the first primary winding adjacent the core, wrapping the secondary winding comprises wrapping the secondary winding at least partially overlying the first primary winding, and wrapping the second primary winding comprises wrapping the second primary winding at least partially overlying the secondary winding.

10. A method in accordance with claim 1, wherein wrapping a first primary winding around a core comprises wrapping the first primary winding around a toroidal core.

11. A transformer comprising:

a core having an outer circumference and an inner circumference defined by an opening through the core;

a first primary winding comprising a plurality of turns wound on the core, the plurality of turns traversing in a first circumferential direction continuously around substantially the entire outer and inner circumferences of the core;

a secondary winding comprising a first portion and a second portion, the first portion comprising a plurality of turns traversing in the first circumferential direction continuously around substantially the entire outer and inner circumferences of the core, the second portion comprising a plurality of turns traversing in a second circumferential direction continuously around substantially the entire outer and inner circumferences of the core, each turn of the plurality of turns of the first portion and the second portion forming a substantially complete loop passing through the opening; and a second primary winding comprising a plurality of turns wound on the core, the plurality of turns traversing in the second circumferential direction continuously around substantially the entire outer and inner circumferences of the core.

12. A transformer in accordance with claim 11, wherein the plurality of turns of the first primary winding and the plurality of turns of the second primary winding comprise a same number of turns.

13. A transformer in accordance with claim 12, wherein the plurality of turns of the first half of the secondary winding and the plurality of turns of the second half of the secondary winding comprise a same number of turns.

14. A transformer in accordance with claim 12, wherein the first primary winding comprises a plurality of conductors, and the second primary winding comprises a same number of conductors as the first primary winding.

15. A transformer in accordance with claim 12, wherein the first primary winding begins at a first position around the circumference of the core and the secondary winding begins at a second position around the circumference of the core different than the first position.

16. A transformer in accordance with claim 12, wherein the first primary winding is adjacent the core, the secondary winding at least partially overlies the first primary winding, and the second primary winding at least partially overlies the secondary winding.

17. A transformer in accordance with claim 11, wherein the core comprises a toroidal core.

18. A power conversion system comprising:

a power converter configured to convert an input power to an output power, the power converter comprising:

a controller;

at least one switch; and a transformer, the transformer including:

a core having an opening there through;

a first primary winding comprising a plurality of turns wound on the core, the plurality of turns traversing in a first circumferential direction continuously around substantially an entire circumference of the core;

a secondary winding comprising a first portion and a second portion, the first portion comprising a plurality of turns traversing in the first circumferential direction continuously around substantially the entire circumference of the core, the second portion comprising a plurality of turns traversing in a second circumferential direction continuously around substantially the entire circumference of the core, each turn of the plurality of turns of the first portion and the second portion forming a substantially complete loop passing through the opening; and a second primary winding comprising a plurality of turns wound on the core, the plurality of turns traversing in the second circumferential direction continuously around substantially the entire circumference of the core.

19. A power conversion system in accordance with claim 18, wherein the plurality of turns of the first primary winding and the plurality of turns of the second primary winding comprise a same number of turns.

20. A power conversion system in accordance with claim 18, wherein the power converter is configured to convert a direct current (DC) input power to a DC output power.

21. A power conversion system in accordance with claim 20, wherein the power converter comprises a flyback converter.

22. A power conversion system in accordance with claim 20, wherein the power conversion system further comprises an inverter configured to convert the DC output of the power converter to an alternating current (AC) output power.

23. A power conversion system in accordance with claim 18, wherein the core comprises a toroidal core.

* * * * *